US008698466B2

(12) United States Patent
Vanderzon

(10) Patent No.: US 8,698,466 B2
(45) Date of Patent: Apr. 15, 2014

(54) START-UP DETECTION IN A DIMMER CIRCUIT

(75) Inventor: James Robert Vanderzon, Adelaide (AU)

(73) Assignee: Clipsal Australia Pty Ltd, Baulkham Hills, New South Wales (AU)

( * ) Notice: Subject to any disclaimer, the term of this patent is extended or adjusted under 35 U.S.C. 154(b) by 836 days.

(21) Appl. No.: 12/678,581

(22) PCT Filed: Sep. 19, 2008

(86) PCT No.: PCT/AU2008/001398

§ 371 (c)(1),
(2), (4) Date: Jun. 11, 2010

(87) PCT Pub. No.: WO2009/036515

PCT Pub. Date: Mar. 26, 2009

(65) Prior Publication Data

US 2010/0289469 A1 Nov. 18, 2010

(30) Foreign Application Priority Data

Sep. 19, 2007 (AU) ..... 2007905108
Sep. 19, 2007 (AU) ..... 2007905109
Sep. 19, 2007 (AU) ..... 2007905110

(51) Int. Cl.
*G05F 1/00* (2006.01)

(52) U.S. Cl.
USPC ..... 323/282; 323/285; 315/248; 315/209 R; 315/291; 315/294; 315/297

(58) Field of Classification Search
USPC ..... 315/291, 248, 224; 324/546
See application file for complete search history.

(56) References Cited

U.S. PATENT DOCUMENTS

| | | | | |
|---|---|---|---|---|
| 4,935,669 | A * | 6/1990 | Nilssen | 315/105 |
| 5,268,964 | A | 12/1993 | Gorman et al. | |
| 2002/0190665 | A1 * | 12/2002 | Sun | 315/224 |
| 2008/0246414 | A1 * | 10/2008 | Xu et al. | 315/291 |

FOREIGN PATENT DOCUMENTS

| | | | |
|---|---|---|---|
| EP | 0923274 | B1 | 4/2002 |
| WO | WO 92/15052 | A1 | 9/1992 |
| WO | WO 03/081364 | A1 | 10/2003 |
| WO | WO 03/081961 | A1 | 10/2003 |
| WO | WO 03/081962 | A1 | 10/2003 |
| WO | WO 2006/023938 | A2 | 3/2006 |

(Continued)

OTHER PUBLICATIONS

PCT International Search Report for PCT/AU2008/001398, Applicant: Clipsal Australia PTY Ltd., et al., Form PCT/ISA/210 and 220, dated Nov. 21, 2008 (3 pages).

(Continued)

*Primary Examiner* — Douglas W Owens
*Assistant Examiner* — Jonathan Cooper
(74) *Attorney, Agent, or Firm* — Vista IP Law Group LLP

(57) ABSTRACT

Disclosed is an inductive load detection circuit for detecting the presence of an inductive load on a dimmer circuit. The detection circuit provides for enhanced detection of the inductive load by detecting voltage ringing resulting from a turn-off of a switching element in the circuit. The ringing can be enhanced by providing a faster turn-off rate in an initial period than a turn-off rate in a steady state period.
Also disclosed is a dimmer circuit comprising the inductive load detection circuit.

6 Claims, 4 Drawing Sheets

(56) References Cited

FOREIGN PATENT DOCUMENTS

| | | | |
|---|---|---|---|
| WO | WO 2007/068040 | A1 | 6/2007 |
| WO | WO 2007/068041 | A1 | 6/2007 |
| WO | WO 2007/068042 | A1 | 6/2007 |

OTHER PUBLICATIONS

PCT Written Opinion of the International Search Authority for PCT/AU2008/001398, Applicant: Clipsal Australia PTY Ltd., et al., Form PCT/ISA/237, dated Nov. 21, 2008 (3 pages).

* cited by examiner

START-UP DETECTION IN A DIMMER CIRCUIT

TECHNICAL FIELD

The present invention relates to Trailing Edge (TE) dimmer circuits and/or Universal Dimmers, and, in particular, to detecting a type of load connected to the dimmer circuit.

PRIORITY

This Application is a U.S. National Stage filing under 35 U.S.C. §371 of International Application No. PCT/AU2008/001398, filed 19 Sep. 2008, which claims priority of Australian Provisional Patent Application No. 2007905110, filed on 19 Sep. 2007, Australian Provisional Patent Application No. 2007905108, filed on 19 Sep. 2007 and Australian Provisional Patent Application No. 2007905109, filed on 19 Sep, 2007, The contents of the aforementioned applications are incorporated by reference as if set forth fully herein. Priority to the aforementioned application is hereby expressly claimed in accordance with 35 U.S.C. §§119, 120, 365 and 371 and any other applicable statutes.

The entire content of each of these applications is hereby incorporated by reference.

INCORPORATION BY REFERENCE

The following documents are referred to in the following description:

PCT/AU03/00365 entitled "Improved Dimmer Circuit Arrangement"; PCT/AU03/00366 entitled "Dimmer Circuit with Improved Inductive Load";

PCT/AU03/00364 entitled "Dimmer Circuit with Improved Ripple Control";

PCT/AU2006/001883 entitled "Current Zero Crossing Detector in A Dimmer Circuit";

PCT/AU2006/001882 entitled "Load Detector For A Dimmer"; and

PCT/AU2006/001881 entitled "A Universal Dimmer".

The entire content of each of these applications is hereby incorporated by reference.

BACKGROUND

Dimmer circuits are used to control the power provided to a load such as a light or electric motor from a power source such as mains power. Such circuits often use a technique referred to as phase controlled dimming. This allows power provided to the load to be controlled by varying the amount of time that a switch connecting the load to the power source is conducting during a given cycle.

For example, if voltage provided by the power source can be represented by a sine wave, then maximum power is provided to the load if the switch connecting the load to the power source is on at all times. In this way the, the total energy of the power source is transferred to the load. If the switch is turned off for a portion of each cycle (both positive and negative), then a proportional amount of the sine wave is effectively isolated from the load, thus reducing the average energy provided to the load. For example, if the switch is turned on and off half way through each cycle, then only half of the power will be transferred to the load. The overall effect will be, for example in the case of a light, a smooth dimming action resulting in the control of the luminosity of the light.

Modern dimming circuits generally operate in one of two ways—leading edge or trailing edge.

In leading edge technology, the dimmer circuit "chops out" or blocks conduction of electricity by the load in the front part of each half cycle (hence the term "leading edge"). In trailing edge technology, the dimmer circuit "chops out" or blocks conduction of electricity by the load in the back part of each half cycle.

FIG. 1A shows a representation of the function of a leading edge dimmer, while FIG. 1B shows the function of a trailing edge circuit.

In FIG. 1A, the shaded region of the sine wave, representing the applied AC power to the load, indicates the part of the cycle during which the dimmer circuit allows electricity to reach the load. The blank region in front of the shaded region indicates the part of the cycle that has been blocked by the dimmer circuit, preventing power from being applied to the dimmer circuit.

In FIG. 1B, the reverse situation, for the trailing edge, is illustrated. In this case, the shaded region at the beginning of the AC cycle indicates the part of the cycle during which the dimmer circuit allows electricity to reach the load. The blank region after the shaded region indicates the part of the cycle that has been blocked by the dimmer circuit, preventing power from being applied to the dimmer circuit.

Which of the two technologies is used for a particular application depends upon the type of the load. Inductive load types (such as iron core low voltage lighting transformers and small fan motors) are best suited to leading edge operating mode, where the established half-cycle load current is terminated when at substantially low levels, thus avoiding undesirable voltage spiking Capacitive load types are best suited to trailing edge operating mode, where the start-of-half-cycle applied load voltage ramps up from zero at a relatively slow rate, thus avoiding undesirable current spiking.

In practice, it has been necessary to select the appropriate dimmer for the appropriate load. This requires stocking multiples of each type of dimmer and has the risk that the incorrect dimmer is connected to a given load.

An improved form of dimmer circuit, known as "adaptive" or "universal" dimmers has been developed, which can function in either the leading edge or trailing edge mode. This alleviates the need to have multiples of each dimmer type to cater for different loads, and the installer does not have to be particularly concerned about the load type. Additionally, from the manufacturing standpoint, only one build type of dimmer is required.

Universal dimmer designs incorporate a means to initially determine which operating mode is suitable for the connected load, in addition to non-volatile memory elements for the purpose of retaining the operating mode thereafter.

SUMMARY

According to a first aspect of the present invention, there is provided an inductive load detection circuit for detecting the presence of an inductive load on a dimmer circuit for controlling delivery of power to the load; the detection circuit comprising:

- a switching element for controlling the delivery of power to the load;
- a switching element control circuit for controlling a turn-off transition time of the switching element; and
- a ringing detector circuit for detecting voltage ringing resulting from the turn-off transition and the inductive load; wherein
- the switching element control circuit causes the switching element to have a faster turn-off rate in an initial period than a turn-off rate in a steady state period.

In one form, the turn-off rate in the initial period is twice the turn off rate in the steady state period.

According to another aspect of the present invention, there is provided a method of detecting the presence of an inductive load for a dimmer circuit having at least one switching device, the method comprising:

causing the at least one switching device to turn off more quickly in an initial period, than in a steady state period; and detecting resulting ringing as an indication of the presence of an inductive load.

In one form, the at least one switching device is caused to turn off twice as quickly in the initial period than in the steady state period.

According to another aspect of the present invention, there is provided a dimmer circuit comprising the inductive load detection circuit of the first aspect.

BRIEF DESCRIPTION OF THE DRAWINGS

Various aspects of the present invention will now be described in detail with reference to the following figures in which.

DETAILED DESCRIPTION

Figure 1A:
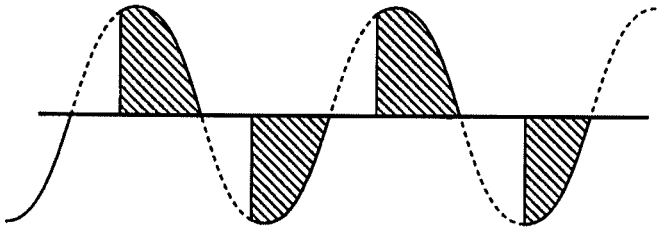
FIGS. 1A and 1B—illustrate the difference between leading edge and trailing edge modes of operation of a dimmer circuit.
Figure 1B:
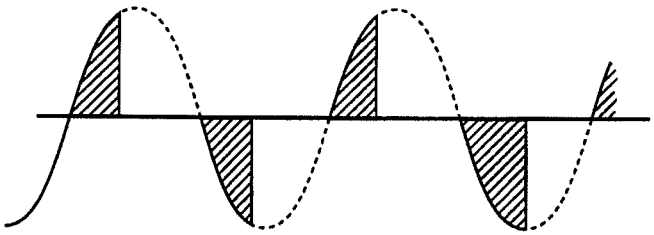

One technique that may be used to detect the presence of an inductive load and to thereby determine a suitable mode of operation is the detection of dimmer terminal voltage spiking, associated with trailing edge mode switching device turn-off transitions where an inductive load is connected. One particular enhanced method is described in PCT/AU2006/001882 entitled "Load Detector For A Dimmer", to the present applicant, the entire content of which is hereby incorporated by reference. In this application, the universal dimmer uses a technique of detection of ringing voltage waveform as a primary means of load type sensing.

One aspect of the present invention as described in the present application provides an enhancement to such techniques. In one form, this is achieved by initially (e.g. in the first 100-200 ms) reducing turn-off transition time to ≤50% of the normal steady state value. This results in a proportional increase in ringing amplitude (typically occurring at low conduction angles) and voltage spiking (typically occurring at higher conduction angles).

In one form, the method provides for an improvement to the sensitivity of detection of inductive low voltage lighting iron core transformer load types in a universal phase-control dimmer primarily operating in trailing edge mode, but capable of detecting the presence of characteristic load voltage ringing or spiking, exceeding a pre-determined amplitude, associated with power device turn-off transitions within each line voltage half-cycle, resulting from connection to an inductive load type and consequently automatically changing over to leading edge mode, whereby the half-cycle load current is permitted to naturally commutate to zero and avoid load voltage ringing or spiking.

The technique of the present invention is particularly useful at low conduction angles where the magnitude of the voltage ringing is lower.

The required level of inductive load detection sensitivity is inversely proportional to the magnitude of the leakage inductance of the iron core transformer.

The selected value of the steady state turn-off transition time within each line voltage half-cycle for the power semiconductors within a universal dimmer operating in trailing edge mode is largely determined by the general requirement to limit associated line conducted Electromagnetic Compatibility (EMC) emission levels. Accordingly, the magnitude of the associated load voltage ringing or spiking is somewhat proportional, over a limited range, to the rate of turn-off of the power devices. An increased voltage magnitude can therefore be achieved by temporarily increasing the rate of turn-off, for example, by a factor of approximately two, over a period of for example, approximately ten line voltage cycle periods, in order to achieve the desired increase in inductive load detection sensitivity.

While it is normally undesirable to increase the rate of turn-off as it increases EMC effects, producing high EMC emissions for a short, initial period of time is not detrimental in the long-term as the EMC requirements relate more to steady state conditions.

As will be understood by the person skilled in the art, the turn-off transition time of an Insulated Gate Bipolar Transistor (IGBT) or Metal-Oxide-Semiconductor Field-Effect Transistor (MOSFET) power semiconductor (switching elements commonly used in dimmer circuits) can generally be controlled by limiting the rate of charge, i.e. current, removal from the device gate terminal. This is usually achieved by appropriate selection of the gate discharge resistor value within the drive circuit. The gate turn-off current can be temporarily increased by a suitable circuit arrangement to switch in an additional resistor to the gate drive circuit.

Figure 2:
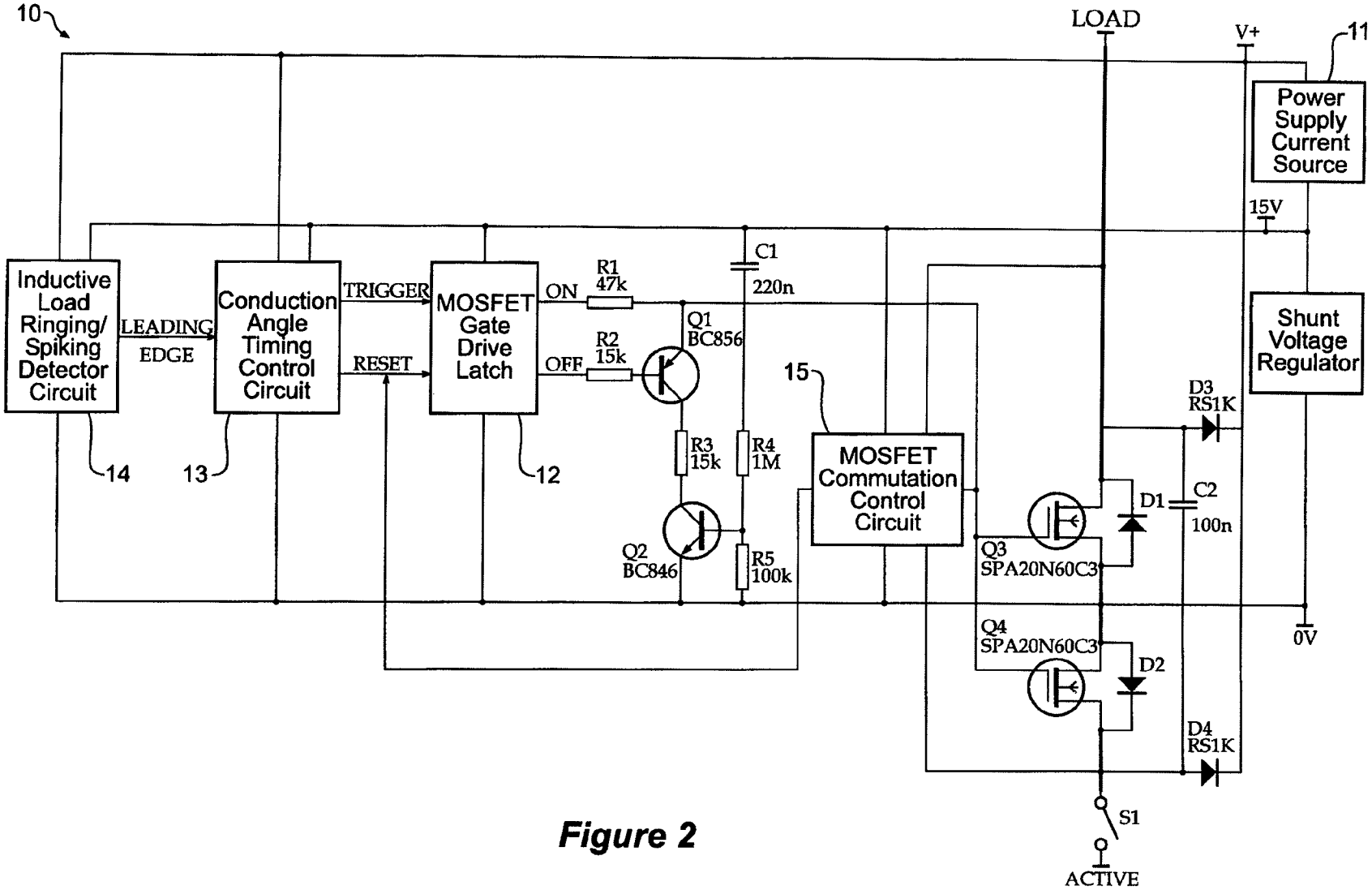
FIG. 2—shows a circuit arrangement according to an aspect of the present invention.

An exemplary circuit arrangement is shown in FIG. 2, which shows dimmer circuit 10 controlling power delivered from active line ACTIVE to load LD, upon actuation of switch 51. The controlling switching elements Q3 and Q4, which in this case are MOSFET devices of type SPA20N60C3, are used to control the amount of power delivered to the load. Each of the switching elements Q3 and Q4 alternately control the power delivery at different polarities as the applied power is of Alternating Current (AC) type, and switches from positive to negative each half-cycle as will be understood by the person skilled in the art.

Power supply to dimmer 10 is provided by rectified line voltage provided by diodes D1, D2, D3 & D4. The power supply current source 11 supplies current to a shunt voltage regulator to establish a low voltage dc rail.

The MOSFET gate drive latch 12 is triggerable to commence gate drive for MOSFET conduction. The latch is resettable to terminate gate drive for MOSFET deactivation. An ON output is an open-collector pull-up to dc rail voltage for gate turn-on event. The complementary OFF output is an open-collector pull-down to 0V voltage reference for gate turn-off event.

Conduction Angle Timing Control Circuit 13, acting as the, or part of the switching element control circuit, contains line voltage zero-crossing detection circuitry and timing control, configurable for either trailing edge or leading edge dimmer operating modes.

The Inductive Load Ringing/Spiking Detector Circuit 14 senses the presence of load voltage ringing or spiking in each line voltage half-cycle, where the dimmer 10 is initially operating in trailing edge mode with an inductive load type, hence causing the conduction angle timing control circuit to change operation to leading edge mode. The ringing frequency is determined by the interaction of capacitor C2 and load inductance.

An exemplary circuit that is able to be used for the inductive load ringing/spiking detector circuit is described in PCT/AU2006/001882 entitled "Load Detector For A Dimmer", previously referred to and incorporated by reference in its entirety.

The MOSFET Commutation Control Circuit 15 functions to detect zero crossing of load current when dimmer 10 operates in leading edge mode, to reset the MOSFET gate drive latch.

The MOSFET commutation control circuit 15 functions only while the dimmer 10 is in leading edge mode, to turn off the MOSFETs at the instant of load zero current crossing for each half-cycle. An example of a suitable circuit for this is described in PCT/AU2006/001883 entitled "Current Zero Crossing Detector in A Dimmer Circuit", to the present applicant, the entire content of which is hereby incorporated by reference.

The operation of the circuit will now be described with reference to FIG. 2.

During trailing edge mode dimmer operation, the MOSFET gate drive latch 12 is triggered at each zero-crossing of line voltage, via the conduction angle timing control circuit 13. Prior to triggering, the ON output has a high impedance state, while the OFF output has low impedance path to 0V reference. The high transition to dc rail voltage level at the ON output of the latch results in current flow through resistor R1 to activate MOSFETs Q3 & Q4.

At the end of the present half-cycle conduction period, the conduction angle timing control circuit 13 resets the MOSFET gate drive latch 12, causing the OFF output to pull low and the ON output to have a high impedance state.

During steady-state dimmer operation, the gate discharge current path is via R2 and Q1 emitter-base junction. At first power up following closure of switch S1, transistor Q2 conducts momentarily—for approximately 10 cycles of the line voltage, due to drive current provided by the charging of C1 via R4. Therefore the initial gate discharge current path comprises both R2 & R3, hence the MOSFET turn-off transition time is reduced for the startup period.

Figure 3:
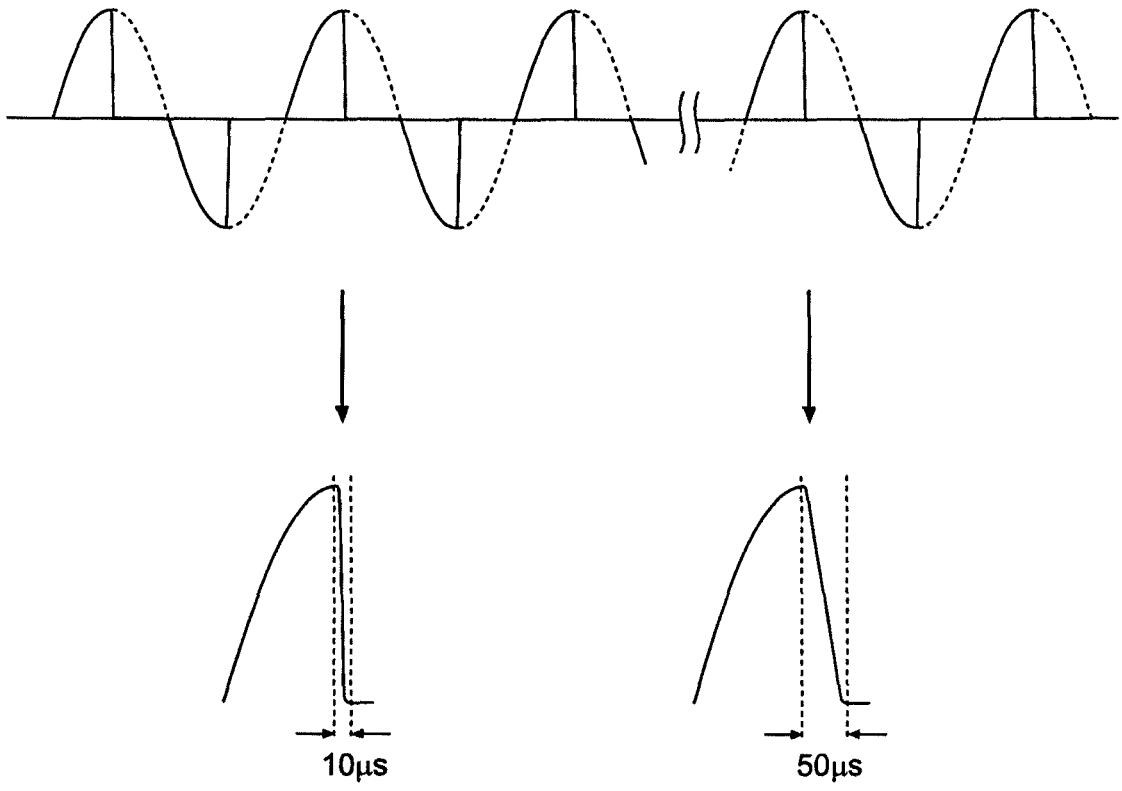
FIG. 3—shows the change in turn-off transition time from an initial period to a steady state period.

FIG. 3 illustrates the change in transition time from the start-up period to the steady-state. It can be seen that in the first 10 cycles for example, the turn-off transition time is about 20 μS, while in the steady state, the turn-off transition time is about 50 μS. Of course, it will be understood that these times may vary as required by design. For example, the timing of the initial turn-off transition time may range from essentially instant turn off to higher. Correspondingly, the initial period turn-off rate may be at least about 150% of the steady state value. Similarly, the length of time or number of cycles selected for the initial period may range from 1 cycle to 50cycles or more.

Furthermore, the turn-off transition time in the initial period may in fact change over subsequent cycles, to "ramp up" from e.g. 10 μS, 20 μS, 30 μS, 40 μS to 50 μS at steady state.

The faster turn-off transitions result in greater amplitude of voltage ringing/spiking across the dimmer line and load terminals. The inductive load detector initiates leading edge mode after several consecutive elapsed line voltage cycles where ringing/spiking is detected.

FIGS. 4 and 5 show the differences in ringing in the initial period to the steady state as the turn-off transition time changes.

Figure 4A:
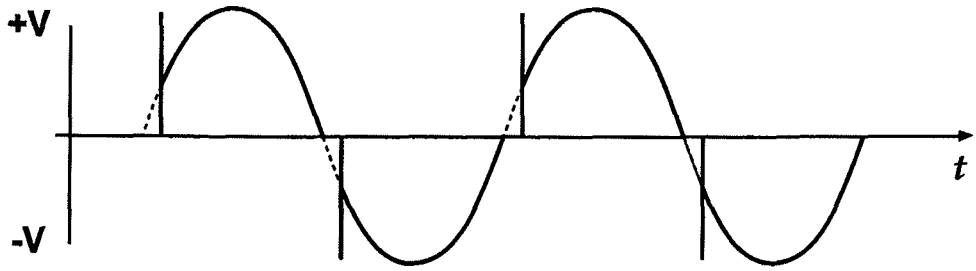
FIGS. 4A and 4B—show the effect of ringing due to the presence of an inductive load.
Figure 4B:
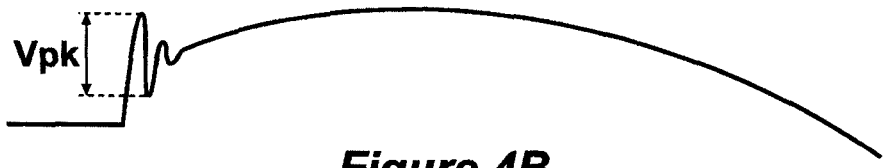

FIGS. 4A and 4B show the voltage across the dimmer as the TE dimmer turns off at a stead state turn off rate.

Figure 5A:
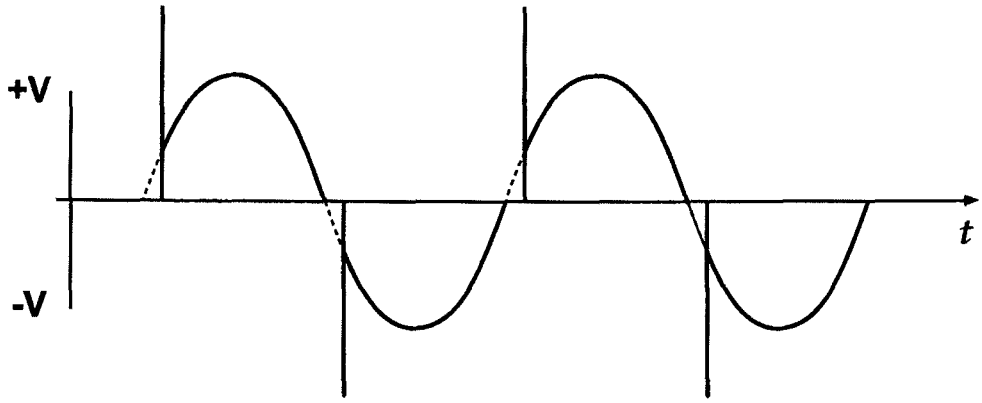
FIGS. 5A and 5B—show the effect of ringing due to the presence of the inductive load and faster turn off.
Figure 5B:
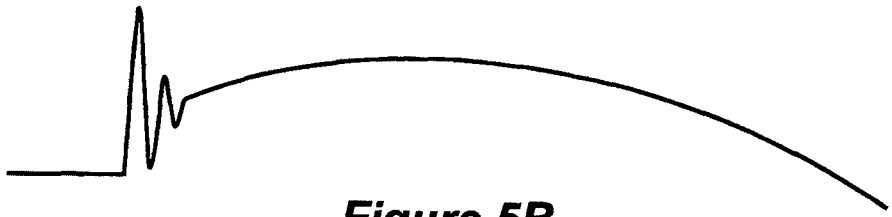

FIGS. 5A and 5B show the voltage across the dimmer as the TE dimmer turns off at a turn off rate that is faster than that of the steady state rate, in the initial period (for example twice as fast). It can be seen that the magnitude of the ringing is greater in the initial period than in the steady state.

It will be understood of course that the technique of the present invention is not limited to the use of the commutation control circuit 15, for example if a single switch is being driven.

It will be appreciated by those skilled in the art that the invention is not restricted in its use to the particular application described. Neither is the present invention restricted in its preferred embodiment with regard to the particular elements and/or features described or depicted herein. It will be appreciated that various modifications can be made without departing from the principles of the invention. Therefore, the invention should be understood to include all such modifications in its scope.

For example, while the use of IGBT and MOSFET switching devices has been shown, the invention is equally applicable to other switching devices such as bi-polar transistors.

Throughout the specification and the claims that follow, unless the context requires otherwise, the words "comprise" and "include" and variations such as "comprising" and "including" will be understood to imply the inclusion of a stated integer or group of integers, but not the exclusion of any other integer or group of integers.

The reference to any prior art in this specification is not, and should not be taken as, an acknowledgement of any form of suggestion that such prior art forms part of the common general knowledge.

The invention claimed is:

1. An inductive load detection circuit for detecting the presence of an inductive load on a phase controlled dimmer circuit for controlling delivery of power to the load; the detection circuit comprising:

a switching element for controlling the delivery of power to the load;

a switching element control circuit for controlling a conduction angle during a line voltage half-cycle that power to the load is to be switched off by the switching element, and for controlling a turn-off transition time of the switching element, wherein the turn-off transition time is a switching fall-time for the line voltage supplied to the load to drop from the line voltage at the conduction angle to zero; and a ringing detector circuit for detecting voltage ringing resulting from the turn-off transition and the inductive load; wherein the switching element control circuit causes the switching element to have a shorter switching fall-time in an initial period than a switching fall-time in a steady state period.

2. An inductive load detection circuit as claimed in claim 1 wherein the switching fall-time in the initial period is half the switching fall-time in the steady state period.

3. A method of detecting the presence of an inductive load for a phase controlled dimmer circuit having at least one switching device that controls a conduction angle during a line voltage half-cycle that power to the load is switched off, the method comprising:

causing the at least one switching device to have a shorter switching fall-time in an initial period, than in a steady state period, wherein the switching fall-time is the time for the line voltage supplied to the load to drop from the line voltage at the conduction angle to zero; and detecting resulting ringing as an indication of the presence of an inductive load.

4. A method as claimed in claim 3 wherein the at least one switching device is caused to have a switching fall-time in the initial period that is half the switching fall-time in the steady state period.

5. A dimmer circuit comprising the inductive load detection circuit as claimed in claim 1.

6. A dimmer circuit comprising the inductive load detection circuit as claimed in claim 2.

* * * * *